US005944263A

United States Patent [19]

Lucco et al.

[11] Patent Number: 5,944,263

[45] Date of Patent: Aug. 31, 1999

[54] DUST SUPPRESSING MISTING DEVICE FOR PERCUSSIVE TOOLS

[75] Inventors: James E. Lucco, Uniontown; John S. Wesolowski, Cuyahoga Falls; Nicholas D. DiCello, Pepper Pike, all of Ohio

[73] Assignee: Everdry Marketing & Management, Inc., Macedonia, Ohio

[21] Appl. No.: 08/963,966

[22] Filed: Nov. 4, 1997

[51] Int. Cl.[6] ..... B05B 15/08; B05B 15/06

[52] U.S. Cl. ..... 239/587.1; 239/289; 239/532; 239/587.4; 239/600; 239/DIG. 8; 173/32; 173/171; 173/199; 173/DIG. 3; 408/61

[58] Field of Search ..... 239/289, 532, 239/548, 587.1, 587.4, 600, DIG. 8; 173/171, 32, 199, DIG. 3, DIG. 4; 408/60, 61; 409/135, 136; 200/69

[56] References Cited

U.S. PATENT DOCUMENTS

| | | | |
|---|---|---|---|
| 819,755 | 5/1906 | Hellman et al. . | |
| 999,429 | 8/1911 | Barry | 408/61 |
| 1,251,455 | 12/1917 | Gilman | 239/289 X |
| 1,264,424 | 4/1918 | Mowlds | 173/32 |
| 1,293,081 | 2/1919 | Gilman . | |
| 1,525,571 | 2/1925 | Cypert | 239/289 X |
| 2,235,582 | 3/1941 | Klema | 239/289 X |
| 2,501,542 | 3/1950 | Sheldon | 173/DIG. 3 X |
| 2,784,701 | 3/1957 | O'Farrell . | |
| 2,911,157 | 11/1959 | Converse | 239/587.4 |
| 3,398,609 | 8/1968 | Schott | 239/298 X |
| 3,503,554 | 3/1970 | Clifton | 239/587.4 X |
| 3,547,350 | 12/1970 | Marcoux | 239/337 |
| 3,700,174 | 10/1972 | Beck | 239/532 X |
| 4,213,354 | 7/1980 | Dahinden | 408/61 X |
| 4,765,542 | 8/1988 | Carlson . | |
| 4,854,393 | 8/1989 | Palet . | |
| 4,930,954 | 6/1990 | Dague | 409/136 |
| 5,052,756 | 10/1991 | Wada et al. . | |
| 5,307,881 | 5/1994 | Kimberlin . | |
| 5,327,979 | 7/1994 | Du et al. . | |
| 5,330,104 | 7/1994 | Marcus . | |
| 5,653,392 | 8/1997 | Wells | 239/588 X |

FOREIGN PATENT DOCUMENTS

| | | | |
|---|---|---|---|
| 4020773 | 1/1992 | Germany | 173/199 |

*Primary Examiner*—Andres Kashnikow
*Assistant Examiner*—Robin O. Evans
*Attorney, Agent, or Firm*—Fay, Sharpe, Beall, Fagan Minnich & McKee

[57] ABSTRACT

A selectively attachable dust suppressing misting device for use with percussive tools, such as air hammers or jack hammers, includes a frame having a first tube section connected to a fluid source. The misting device includes one or more misting nozzles connected to the first tube section to allow fluid to flow out of the misting device. The misting nozzles are rotatable to allow fluid to be sprayed in a desired direction. The device also includes at least one adjustable clamp for securing the device to various diameters of percussive tools. Preferably, a second clamp is mounted to a housing slidable on the first tube section to allow the second clamp to be moved with respect to the first clamp.

16 Claims, 4 Drawing Sheets

DUST SUPPRESSING MISTING DEVICE FOR PERCUSSIVE TOOLS

BACKGROUND OF THE INVENTION

The present application relates generally to dust suppressors. More particularly, it relates to an improved liquid mist dust suppressor device for use with percussive tools such as air powered hammers.

The invention is particularly suited for use in spraying a dust suppressing mist on a concrete or other hard surface being drilled or cut to reduce the amount of dust thrown in up into the air as a result of such drilling or cutting. The invention can be used in conjunction with an air hammer or a jack hammer when cutting into a concrete foundation or floor to replace, repair or install drainage systems to prevent water from seeping into a building. However, it should be appreciated that the apparatus could also be used in many other applications, such as drilling or cutting concrete outdoors.

The seepage of water into a building is a problem which commonly plagues the construction industry. This problem occurs in buildings which have basements as well as in buildings built on a slab foundation. In particular, the seepage problem has plagued buildings having a below ground foundation wall.

It is known that the foundation wall of a building is most often made from hollow concrete blocks, and water is able to pass from the exterior surrounding ground of the building through cracks, holes, natural pores, etc. in the block into hollow cavities of the block and thence to the basement floor. Even if the foundation wall is made from solid blocks or poured concrete, water may seep into the basement through cracks and by capillary action.

To correct the problem of water seeping into a foundation wall and into a basement, the foundation must be dug up to install, repair or replace a drainage system. An air hammer is most frequently used for this purpose. When an air hammer or like percussion tool is used indoors to drill concrete, a significant amount of concrete dust is thrown up into the air by the chisel or drill bit of the tool. This concrete dust can cause damage to furniture, rugs, and walls as well as create a dirty environment in the home or building requiring a time-consuming and potentially costly clean-up effort.

By installing a dust suppressing misting device onto the percussion tool, a spray of fluid, such as water or soapy water, can be applied to the surface being drilled or cut to reduce the amount of concrete dust thrown up into the atmosphere during the drilling or cutting process. Numerous misting devices have been developed for use in drilling, cutting and for other applications. One known device is shown in U.S. Pat. No. 4,854,393. This device is a combination air hammer, water stream blaster and liquid mist suppressor. The air hammer removes material which is swept away by the water stream blaster while the liquid mist suppressor mists the work area and any dust stirred up by the tool while in use. A disadvantage of this known device is that the misting apparatus is integral to the air hammer, resulting in the misting apparatus only being able to be used with that particular air hammer. In addition, if the air hammer needs repair and has down time, the misting apparatus cannot be detached and used with a different percussion tool until the air hammer is repaired. Also, the known apparatus only mists in one fixed direction with respect to the air hammer. The apparatus does not have misting nozzles that can be adjusted to mist in various desired directions.

Another known apparatus for a misting drilling device is disclosed in U.S. Pat. No. 819,755. This patent also shows a misting apparatus which is integral to the drilling device. This device has misting holes which may be slightly inclined outward to cause the misting spray to encompass a larger drilling area. However, this device also has the same shortcomings of the previously discussed device. Namely, the misting apparatus cannot be removed from the drilling device and used with other size drills or other percussive tools.

Another known drill device, which is disclosed in U.S. Pat. No. 2,784,701, combines a water control with a rock drill device. This device has the same shortcomings as the devices discussed above. In addition, this device does not provide a misting capability or the ability to direct the flow of water in various desired directions.

Another device disclosed in U.S. Pat. No. 5,052,756 uses pressurized water to separate asbestos-containing material from a surface and to prevent the floating of dust in the air. This device can only be used to apply pressurized water to a surface; it is not attachable to a drill or other percussive tool. Thus, it would not be as efficient to use in a drilling process where the drill and the water pressurizer would have to be separately operated.

Accordingly, it has been considered desirable to develop a new and improved dust suppressing misting device for use with percussive tools, such as air hammers or jack hammers which would overcome the foregoing difficulties and others while providing better and more advantageous overall results.

BRIEF SUMMARY OF THE INVENTION

The present invention relates to a selectively attachable dust suppressing misting apparatus for use with percussive tools.

More specifically, the misting apparatus is used to suppress the dust stirred up while drilling a concrete surface or other similar hard surface. The apparatus is attachable to a variety of percussive tools of different diameters and sprays a mist of fluid in a desired direction onto the surface being drilled to reduce the amount of dust thrown up into the air during the drilling or cutting process.

The misting apparatus comprises a frame with at least one tube section connected to a fluid source, at least one misting nozzle connected to the tube section, and at least one clamp connected to the tube section for selectively fastening the frame to an associated percussive tool.

If desired, the misting apparatus can further comprise a first fitting having a first end secured to said first tube section and a second tube section secured to a second end of the first fitting, wherein the second tube section is rotatable about the longitudinal axis of the first tube section and is oriented at an obtuse angle with respect to the first tube section. The second tube section can pivot about the longitudinal axis of the percussive tool to allow connection to a fluid source from various locations with respect to the tool. Also, pivoting the second tube section facilitates installing the misting device onto the percussive tool.

The misting device can also be comprised of third, fourth, fifth and sixth tube sections connected by respective fittings to each other and the second tube section. A flow valve is attached to the fourth tube section to control the flow of fluid through the nozzle. A fitting to attach a hose to the misting device is attached to the sixth tube section. The sixth tube section is rotatable with respect to the fifth tube section to facilitate installing a hose onto the misting device in different orientations.

In accordance with another aspect of the invention, a second misting nozzle is attached to the first tube section in a spaced manner with respect to the first misting nozzle. A tubular connecting member may be used to install the two misting nozzles onto the misting device. The connecting member comprises a base end attached to the first tube section and a pair of legs to which a respective one of the misting nozzles is attached.

More particularly in accordance with another aspect of the invention, the misting nozzles may be rotatable with respect to the first tube section to allow fluid to be sprayed in a desired direction. Also, the misting device may be further comprised of a second clamp which is connected to a housing which is movably attached to the first tube section to allow the second clamp to move with respect to the first clamp. The clamps are also adjustable to allow the misting device to be attached to varying diameters of percussive tools. To allow for adjustment, the clamps may be comprised of a base and a U-shaped fastening element which is adjustably mounted with respect to the base.

One advantage of the present invention is the provision of a dust suppressing misting device which is selectably attachable to a percussive tool.

Another advantage of the present invention is the provision of a misting device which has a second tube section that is rotatable with respect to a first tube section to position the second tube section in a desired angular orientation in relation to the first tube section.

Yet another advantage of the present invention is the provision of a misting device which has a tube section which is rotatable to allow a hose fitting to rotate with respect to the frame of the misting device.

Still another advantage of the present invention is the provision of a misting device which has two misting nozzles spaced apart from each other, wherein the misting nozzles are rotatable in relation to the first tube section longitudinal axis to allow fluid to be sprayed in a desired direction.

Still yet another advantage of the present invention is the provision of a misting device which has two clamps which are adjustable to allow the misting device to be attached to varying diameters of percussive tools.

A further advantage of the present invention is the provision of a misting device which has a second clamp which comprises a housing that is movable with respect to the first tube section to allow the second clamp to move with respect to the first clamp. This design allows the misting device to be attached to varying sizes of percussive tools.

Still other benefits and advantages of the present invention will become apparent to those skilled in the art upon a reading and understanding of the following detailed specification.

BRIEF DESCRIPTION OF THE DRAWINGS

The invention will take form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 1:
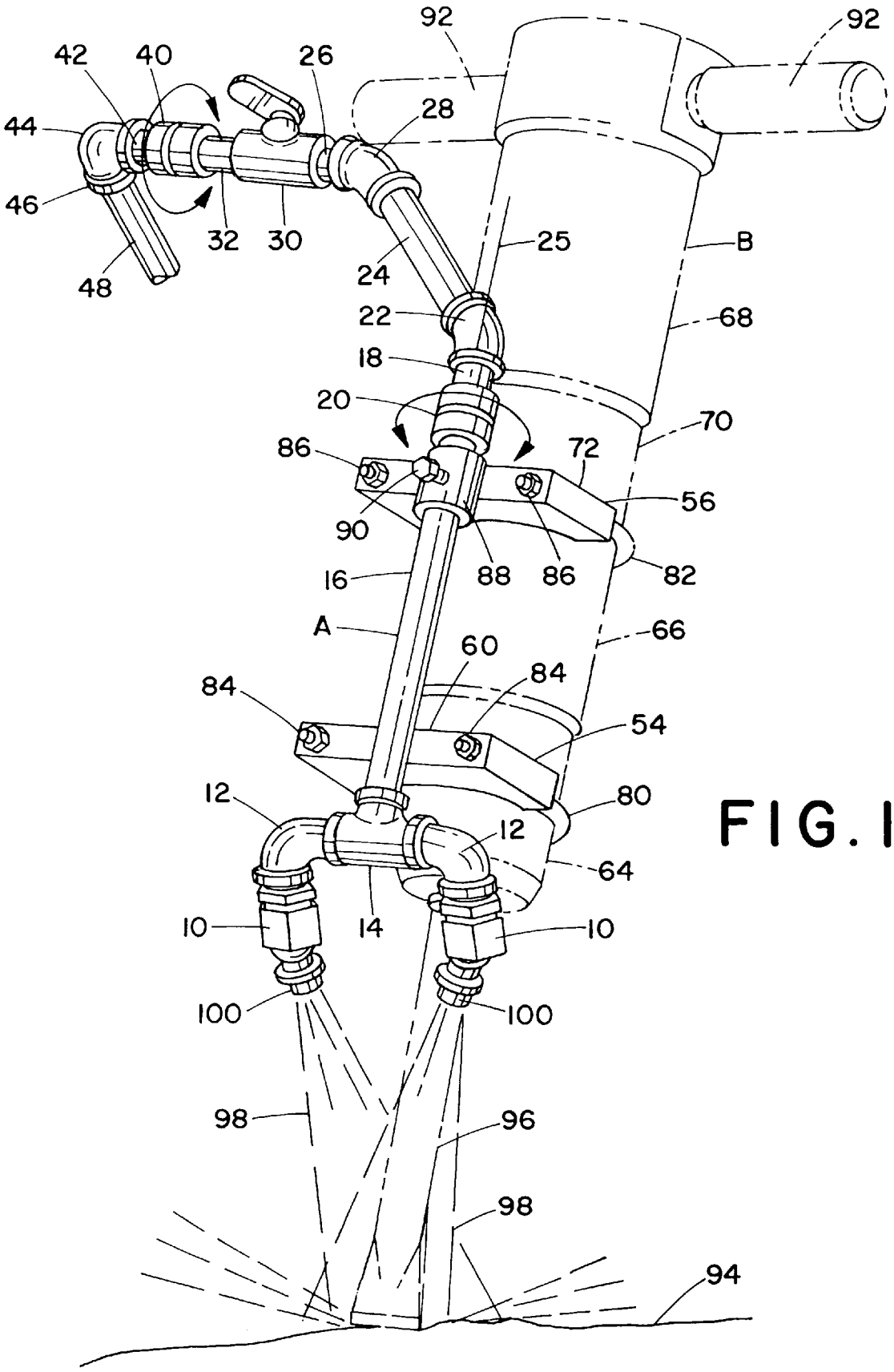
FIG. 1 is a perspective view of a misting device attached a percussive tool in accordance with the present invention.

Referring now to the drawings, wherein the showings are for purposes of illustrating a preferred embodiment of this invention only and not for purposes of limiting same, FIG. 1 shows the misting device A of the present invention as attached to a percussive tool. While the percussive tool is shown to be a particular type of air hammer B, it should be appreciated that the misting device could be attached also to a jack hammer, as well as a variety of other tools.

When an air hammer B is used for drilling a concrete foundation or floor, concrete dust is created. To reduce the amount of dust thrown up into the air, the misting device A can be attached to the air hammer B to spray a dust suppressing fluid, such as water or soapy water, as shown in FIG. 1. The misting device has a pair of spaced misting nozzles 10. These can be standard spray nozzles, termed mini-mist nozzles (Part No. 3178K75) which are available from McMaster-Carr, located in Aurora, Ohio. The nozzles spray a full cone pattern of fluid at an 80° spray angle at a rate of 3.16 gallons of fluid at a pressure of 500 psi. The misting nozzles are attached to the misting device with conventional elbows 12 and a known tee-fitting 14. The tee fitting 14 is, in turn, attached to a first end of the first tube section 16 of the misting device. The first tube section 16 is attached, at its second end, to a second tube section 18 by a known rotatable fitting 20 which is commonly available from hardware stores. The second tube section 18 is, in turn, connected by a known elbow 22 to a third tube section 24 which is oriented at an obtuse angle with respect to a longitudinal axis 25 of the first tube section 16.

Figure 2:
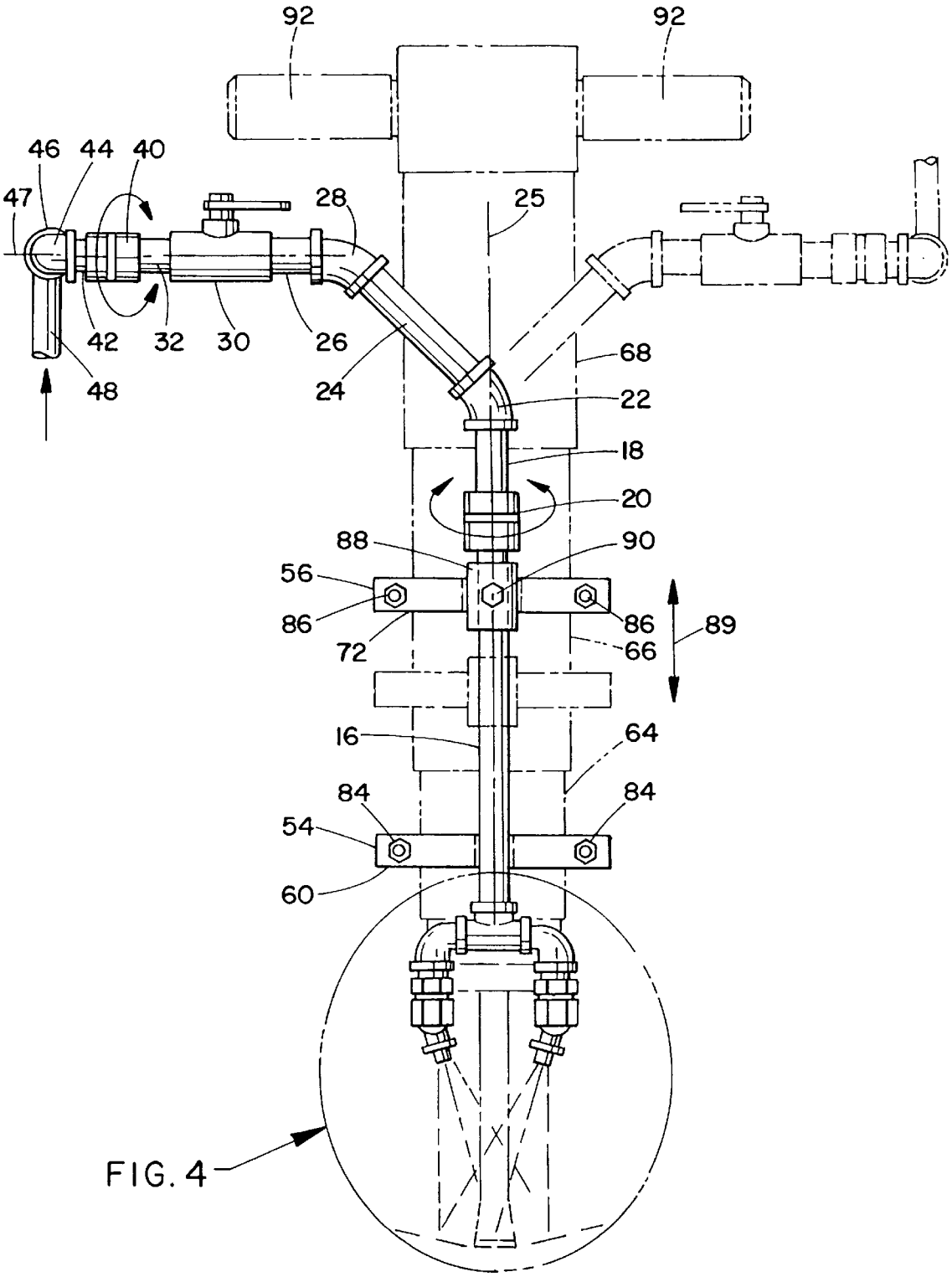
FIG. 2 is a front elevational view of the misting device of FIG. 1.

As shown in FIG. 2, the third tube section 24 is rotatable about the longitudinal axis 25 of the first tube section 16 by means of the rotatable fitting 20 to positions on either side of the air hammer B. Such adjustability allows either a left-handed operator or a right-handed operator of the air hammer B to comfortably use the misting device A. A fourth tube section 26 is attached to the third tube section 24 by a known elbow 28. A conventional manually controllable flow valve 30 is connected to one end of the fourth tube section 26. The other end of the fourth tube section 26 is connected to one end of a fifth tube section 32. Connected to another end of the fifth tube section 32 is a known rotatable fitting 40, as shown in FIG. 1 and FIG. 2. On the other side of the fitting 40 is a short sixth tube section 42 leading to an elbow 44.

A hose fitting 46 is attached to the elbow 44. The rotatable fitting 40 allows the hose fitting 46 to rotate along a longitudinal axis 47 of the fifth tube section 32, as shown in FIG. 2. A hose 48 is attached to the hose fitting 46 and to a fluid source (not shown) to provide fluid to the misting device A. Rubber grommets (not shown) may be installed at the various elbows 12,22,28,44 and tee-fitting 14 as well as the rotatable fittings 20, 40 and the hose fitting 46 to prevent leakage of the fluid out of the misting device A.

The hose 48 is preferably a ⅜" diameter hose made from a conventional resilient material, such as rubber or thermoplastic. Applicants have found that a ⅜" diameter hose—commonly used as the air hose for air powered tools—is advantageous from the standpoint of being easier to handle than conventional water hoses, such as garden hose. This hose also provides a higher pressure and a lower flow rate of the fluid than does the conventional garden hose.

Figure 3:
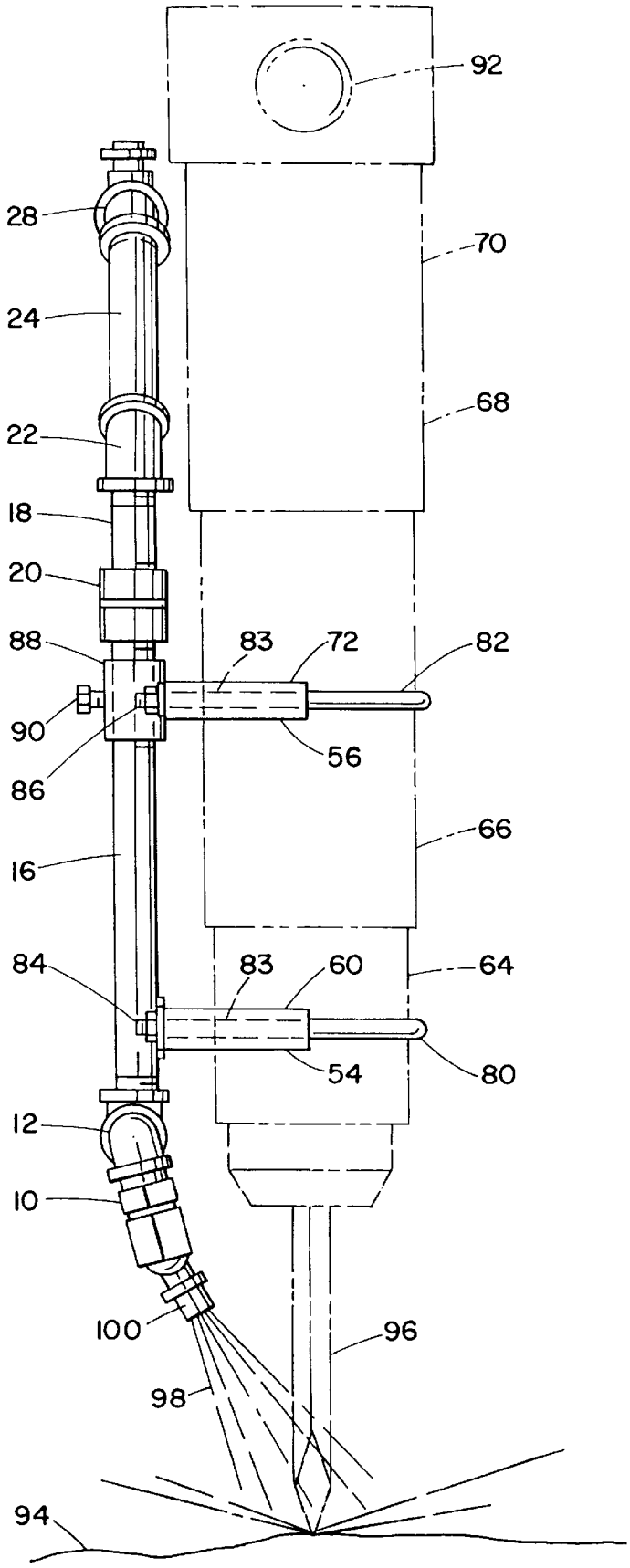
FIG. 3 is a side elevational view of the misting device of FIG. 1.

The misting device A is selectively fastened to the air hammer B by first and second clamp assemblies 54 and 56. The first clamp assembly 54 includes a base 60, which has a semi-circular recess to engage one of the first, second or third sections 64,66,68, of a body 70 of the air hammer B. The second clamp assembly 56 includes a similar base 72. The respective clamp assemblies 54 and 56 also each include respective U-shaped clamp members 80,82 which fit around the air hammer body sections 64,66,68, as shown in FIG. 1. As shown in FIG. 3, each U-shaped clamp member 80,82 includes a threaded area 83 on the distal ends of two straight leg portions of the U-shaped clamp. These are inserted into respective spaced holes (not visible) in each base 60,72 and are secured with respective nuts 84,86. Depending on the diameter of the section of the air hammer body 70 which is being held, the distal ends of the U-shaped clamp legs protrude more or less from the holes of the base 60,72. The clamp assemblies are spaced apart from one another and each is adjustable to accommodate various size sections 64,66,68 of the air hammer body 70.

The base 72 of the second clamp assembly 56 is secured to a collar 88 which is slidably mounted onto the first tube section 16, as shown in FIG. 2 by the arrow 89. The collar 88 can be slid up or down the first tube section 16 to a desired location along one of the sections of the air hammer body 70 and is secured in a desired position by a screw 90 which is threaded into a threaded hole (not visible) in the collar 88 until a tip of the screw engages the outer wall of the first tube section 16.

When the misting device A is secured in the desired position with respect to the air hammer B, the air hammer B is operated by holding a pair of handles 92 and drilling a work surface 94 with a blade 96. The misting device A allows the fluid to flow from the hose 48 through the various tube sections and fittings by opening the flow valve 30. The fluid, such as water or soapy water, then flows out of the misting device A as a spray 98 through a tip 100 of each of the misting nozzles 10.

Figure 4:
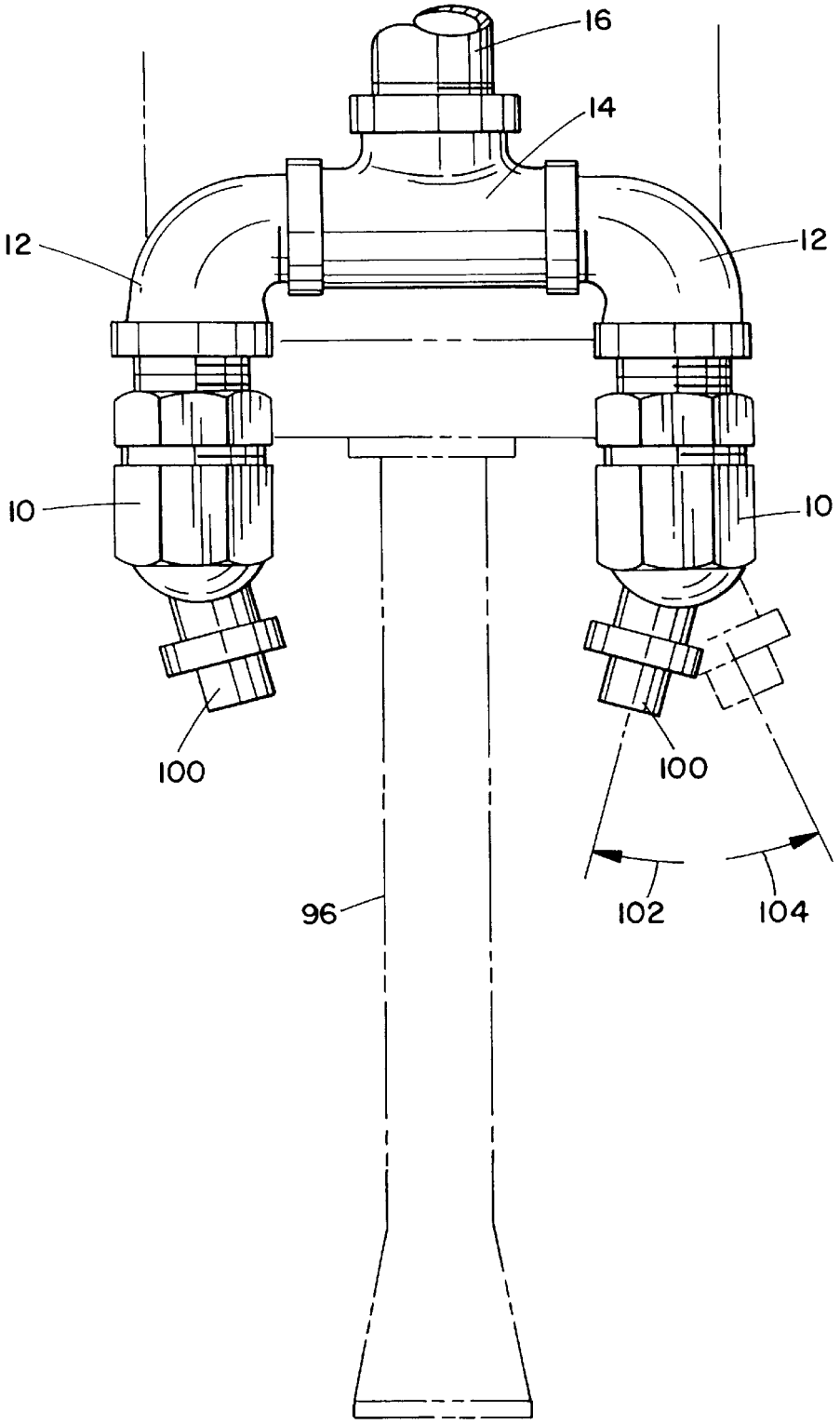
FIG. 4 is an enlarged front elevational view of the misting nozzles of the misting device of FIG. 1.

It should be appreciated that the misting nozzles 10 can be rotated in relation to the longitudinal axis of the first tube section 16 to allow the fluid spray 98 to be directed in a desired direction, such as inwardly towards the air hammer blade 96, as shown in FIG. 3. The misting nozzles 10 can also be rotated to point towards each other or away from each other so that the spray 98 from both misting nozzles 10 can be aimed at the same location or at different locations on the work surface 94, as shown by the arrows 102 and 104 in FIG. 4. It is evident from FIG. 1 that the two sprays 98 overlap at the point of impact of the blade 96 on the work surface 94 to provide a more complete suppression of the dust which is stirred up by the motion of the blade.

The tips 100 of the misting nozzles 10 can be replaced to adjust the volume of spray 98 flowing from the misting nozzles 10 per unit time. A wider spray for outdoor applications or a narrower spray for indoor applications can be achieved by changing the tip 100 of the misting nozzles 10.

The invention has been described with reference to a preferred embodiment. Obviously, alterations and modifications will occur to others upon a reading and understanding of this specification. It is intended to include all such modifications and alterations insofar as they come within the scope of the appended claims or the equivalents thereof.

Having thus described the present invention, it is now claimed:

1. A selectively attachable dust suppressing misting apparatus for percussive tools, comprising:

a frame comprising a first tube section connected to a fluid source, wherein the first tube section has a longitudinal axis and allows fluid to pass therethrough;

a first misting nozzle and a second misting nozzle connected to said first tube section in a spaced-apart manner wherein said first and second misting nozzles allow fluid to flow out respective tips thereof, wherein said first and second misting nozzle tips are rotatable in relation to the longitudinal axis of said first tube section to allow fluid to be sprayed in a desired direction; and, a first clamp connected to the first tube section for selectively fastening said frame to an associated percussive tool.

2. The misting apparatus of claim 1 further comprising:

a first fitting having a first end secured to said first tube section; and, a second tube section secured to a second end of said first fitting, wherein said second tube section is rotatable about the longitudinal axis of the first tube section via said first fitting in order to position said second tube section in a desired angular orientation in relation to said first tube section.

3. The misting apparatus of claim 2 further comprising a third tube section connected to said second tube section by a second fitting.

4. The misting apparatus of claim 3 further comprising a fourth tube section connected to said third tube section by a third fitting.

5. The misting apparatus of claim 4 further comprising a fifth tube section connected to said fourth tube section by a fourth fitting and a sixth tube section connected to said fifth tube section by a fifth fitting.

6. The misting apparatus of claim 5 wherein said sixth tube section is rotatable with respect to said fifth tube section via said fifth fitting.

7. The misting apparatus of claim 4 further comprising a manually controllable flow valve connected to said fourth tube section.

8. The misting apparatus of claim 5 further comprising a hose fitting connected to said sixth tube section.

9. The misting apparatus of claim 1 further comprising a second clamp connected to said first tube section and spaced from said first clamp and both said first and second clamps are adjustable to allow the apparatus to be attached to varying sizes of percussive tools.

10. The misting apparatus of claim 1 further comprising a tubular connecting member comprising a base end attached to said first tube section and a pair of legs to which a respective one of said first and second misting nozzles is secured.

11. A misting apparatus as defined in claim 9 wherein said second clamp comprises a housing which is movable with respect to said first tube section to allow said second clamp to move with respect to said first clamp.

12. A selectively attachable dust suppressing misting apparatus for percussive tools, comprising:

a frame comprising a first tube section connected to a fluid source, wherein the first tube section has a longitudinal axis and allows fluid to pass therethrough;

a first misting nozzle connected to said first tube section wherein said first misting nozzle allows fluid to flow out a tip thereof;

a first clamp connected to the first tube section for selectively fastening said frame to a first portion of an associated percussive tool, said first clamp comprising a base and a U-shaped fastening element which is adjustably mounted with respect to said base; and a second clamp spaced from said first clamp, said second clamp comprising a base, a U-shaped fastening element which is adjustably mounted with respect to the base, and a housing which is slidably mounted with respect to said first tube section, wherein said base is secured to said housing.

13. The misting apparatus of claim 12 further comprising a second misting nozzle attached to said first tube section in a spaced manner from said first misting nozzle.

14. A selectively attachable dust suppressing misting apparatus for percussive tools, comprising:

a frame comprising a first tube section connected to a fluid source, wherein said first tube section has a longitudinal axis and allows fluid to pass therethrough;

a first misting nozzle and a second misting nozzle which are each connected to said first tube section wherein said first and second misting nozzles allow fluid to flow out of respective tips thereof; and, a first clamp and a second clamp attached in a spaced apart manner to said first tube section for selectively fastening said frame to an associated percussive tool, wherein said first and second clamps are adjustable to accommodate varying sized portions of the associated percussive tool and said second clamp is movable in relation to the first clamp to accommodate different associated percussive tools.

15. The misting apparatus of claim 14 further comprising a first fitting having a first end secured to said first tube section and a second tube section secured to a second end of said first fitting, wherein said second tube section is rotatable about the longitudinal axis of the first tube section via said first fitting in order to position said second tube section in a desired angular orientation in relation to said first tube section.

16. The misting apparatus of claim 14 further comprising a tubular connecting member comprising a base end connected to said first tube section and a pair of legs to which a respective one of said first and second misting nozzles is secured.

* * * * *